US007813877B2

(12) United States Patent
Caminiti et al.

(10) Patent No.: US 7,813,877 B2
(45) Date of Patent: Oct. 12, 2010

(54) RELEVANCY CHECK FOR VEHICLE SAFETY MESSAGES USING A PATH HISTORY

(75) Inventors: Lorenzo Caminiti, Ann Arbor, MI (US); Derek S. Caveney, Ann Arbor, MI (US); Kenneth P. Laberteaux, Ann Arbor, MI (US); Michael E. Samples, Toledo, OH (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 1016 days.

(21) Appl. No.: 11/554,084

(22) Filed: Oct. 30, 2006

(65) Prior Publication Data

US 2008/0103697 A1 May 1, 2008

(51) Int. Cl.
*G08G 1/16* (2006.01)

(52) U.S. Cl. ..... 701/301; 701/300

(58) Field of Classification Search ..... 701/300, 701/301

See application file for complete search history.

(56) References Cited

U.S. PATENT DOCUMENTS 6,111,521 A 8/2000 Mulder et al.
6,252,520 B1 6/2001 Asami et al.
6,259,377 B1 7/2001 Noecker et al.
6,359,552 B1 3/2002 King
6,445,308 B1 * 9/2002 Koike ..... 340/902
6,714,127 B2 3/2004 Perez et al.
6,765,495 B1 7/2004 Dunning et al.
6,799,100 B2 * 9/2004 Burns et al. ..... 701/25
6,845,324 B2 1/2005 Smith
6,861,957 B2 3/2005 Koike
7,084,882 B1 * 8/2006 Dorum et al. ..... 345/589
7,532,130 B2 * 5/2009 Curtis ..... 340/902
2002/0186146 A1 12/2002 Mikhaylenko et al.
2004/0246144 A1 12/2004 Siegel et al.
2005/0088318 A1 4/2005 Liu et al.
2005/0093717 A1 5/2005 Lilja
2005/0131629 A1 6/2005 Ignatin
2005/0197775 A1 9/2005 Smith
2005/0237224 A1 10/2005 Gotfried
2007/0043502 A1 * 2/2007 Mudalige et al. ..... 701/207
2007/0080825 A1 * 4/2007 Shiller ..... 340/903

* cited by examiner

*Primary Examiner*—Thomas G Black
*Assistant Examiner*—Peter D Nolan
(74) *Attorney, Agent, or Firm*—Gifford, Krass, Sprinkle, Anderson & Citkowski, P.C.

(57) ABSTRACT

There is disclosed a method for avoiding a collision in a vehicle including the steps of: providing a transmitting vehicle, providing a receiving vehicle, creating data information in the transmitting vehicle, sending the data information to the receiving vehicle, and determining the relevancy of the data information to the receiving vehicle using a current position and heading of the receiving vehicle.

19 Claims, 2 Drawing Sheets

RELEVANCY CHECK FOR VEHICLE SAFETY MESSAGES USING A PATH HISTORY

FIELD OF THE INVENTION

The invention relates to a method of avoiding a collision in a vehicle.

BACKGROUND OF THE INVENTION

Various collision warning systems are known in the art. Various examples include vehicles having systems including a detector such as a radar or other device associated with the vehicle to detect objects within a path of the vehicle. Based on the distance between an object and the vehicle as well as the velocity of the vehicle, various parameters of the vehicle's system can be controlled, such as a braking of the vehicle or a warning transmitted to the driver.

Additionally vehicle collision warning systems may include a network of vehicles that interact with each other and are required to be mapped using a GPS configuration of an operating environment. Such systems are complicated and require vehicles to know their position relative to the digital map to provide accurate warning and collision prevention signals.

There is therefore a need in the art for a collision prevention system and method of operation of such a system that eliminates the need for accurate digital mapping as well as provides a reliable system for determining the relevancy of messages transmitted between vehicles.

SUMMARY OF THE INVENTION

There is disclosed a method for avoiding a collision in a vehicle including the steps of: providing a transmitting vehicle, providing a receiving vehicle, creating data information in the transmitting vehicle, sending the data information to the receiving vehicle, and determining the relevancy of the data information to the receiving vehicle using a current position and heading of the receiving vehicle.

DETAILED DESCRIPTION OF THE PREFERRED EMBODIMENTS

There is disclosed a method for avoiding a collision in a vehicle that includes the following steps: providing a transmitting vehicle, providing a receiving vehicle, creating data information in the transmitting vehicle, sending the data information to the receiving vehicle, and then determining the relevancy of the data information to the receiving vehicle using a current position and heading of the receiving vehicle.

The data information created by the transmitting vehicle may be created using a variety of techniques. One such technique includes generating data information including data that has a position element and a temporal element. The data information includes a position and time of the transmitting vehicle. The data information may be generated having equally spaced time data elements or alternatively having different time spacing of the data elements. The data information having equally spaced time increments will have the same number of data elements regardless of a path history of the transmitting vehicle. The equally spaced data information includes the same number of data points for a straight path of a transmitting vehicle as with a complicated curved path of the transmitting vehicle. In an alternative aspect, the data information may have different time spacing and may have varying numbers of data elements.

The data information, as stated above, includes a plurality of data points having a position element and a temporal element. Various numbers of data elements or data points may be used in the method. When a path of the transmitting vehicle is not complicated, it may be possible to represent the data information with less data elements. Various numbers of data elements may be used to create the data information and may be dependent upon the path history of the transmitting vehicle. The number of data elements or data points may be determined by various run time calculations to determine the appropriate number of data elements to include in the data information.

It should be realized that the data information do not need to be piecewise linear or represented by discrete data elements. Various other data information including curves represented by functions and cubic spline interpolations between discrete data elements that include an orientation may be used by the invention. It should be realized that the method of the present invention is independent of the specific data information that is utilized by the transmitting vehicle.

Figure 1:
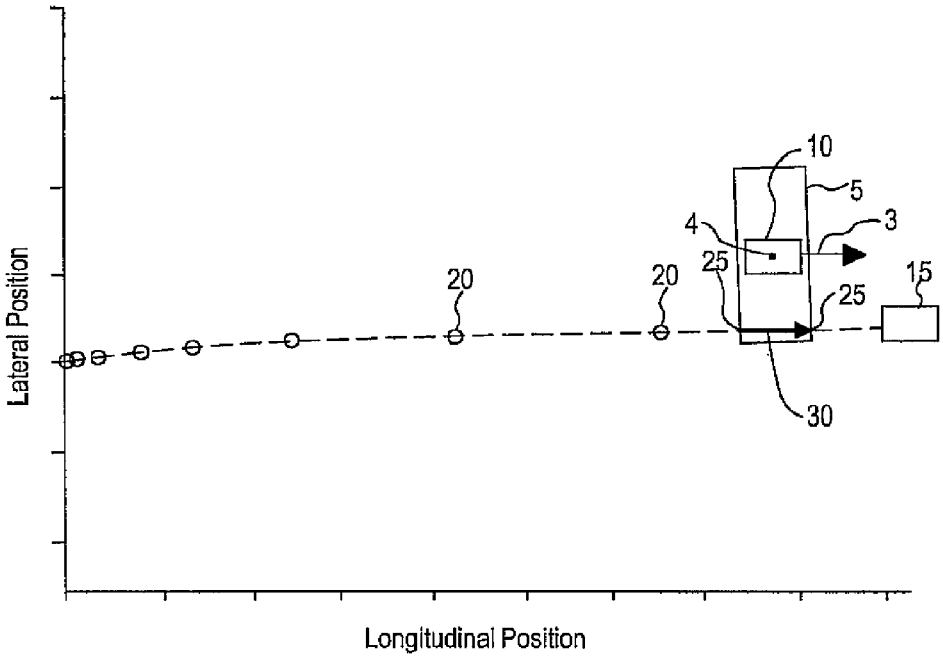
FIG. 1 is a depiction of a lateral position and longitudinal position of a transmitting and receiving vehicle indicating a bounding area of the receiving vehicle, the data information of the transmitting vehicle and an intersection of the data points and bounding area.
Figure 2:
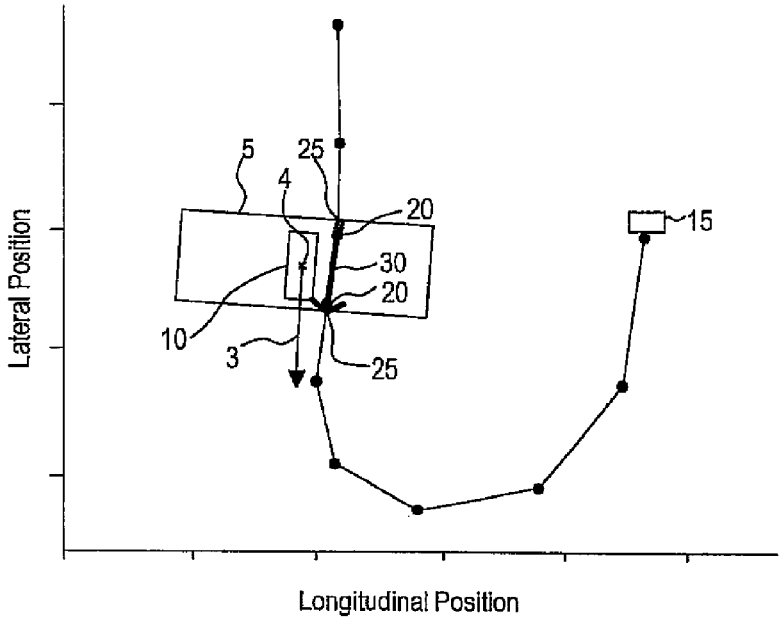
FIG. 2 is a plot similar to that of FIG. 1 indicating the lateral position and longitudinal position of a transmitting and receiving vehicle with an alternate path of the data information of the transmitting vehicle.

In one aspect of the invention, and as depicted in FIGS. 1 and 2, a bounding area 5 may be created in the receiving vehicle 10. The bounding area 5 may be represented by a variety of different shapes including polygons and circular shapes. The choice of a shape for a specific application may depend on various parameters such as the type of vehicle and road on which the receiving vehicle 10 is traveling. Additionally, the size and shape of the bounding area 5 may be time varying in order to incorporate dynamic vehicle and driving parameters. In one aspect, the bounding area 5 may be centered about the receiving vehicle 10. However, the bounding area 5 may be offset relative to the current position of the receiving vehicle 10, as well. As seen in FIG. 1, the bounding area 5 may be represented by a rectangular shape that is centered at the current position of the receiving vehicle 10. If the rectangular shape is time invariant and does not change, it can be defined by a width and height and then dynamically translated and oriented to the current receiving vehicle's position and heading.

As stated above, the method of the invention includes determining a relevancy of the data information with respect to the receiving vehicle 10 using a current position and heading of the receiving vehicle 10. The relevancy is determined when the transmitting vehicle 15 determines that it must communicate data information to neighboring vehicles. As stated above, the data information may be transmitted at a specific time interval or frequency or it may be periodic or event driven.

Following the transmission of the data information, the receiving vehicle 10 constructs a bounding area 5, as described above. For each consecutive pair of data elements 20 contained in the data information an equation of a fine segment connecting the pair is calculated. Next it is determined if the line segment intersects with a perimeter of the bounding area 5. The intersection points 25, if any, of the line segment with the perimeter are computed. If an intersection point 25 exists, its timestamp is computed by interpolating the timestamps associated with the pair of data points 20. If no intersection points 25 exist between the bounding area 5 of the receiving vehicle 10 and the data information, the receiving vehicle 10 will ignore the transmitted message.

Figure 3:
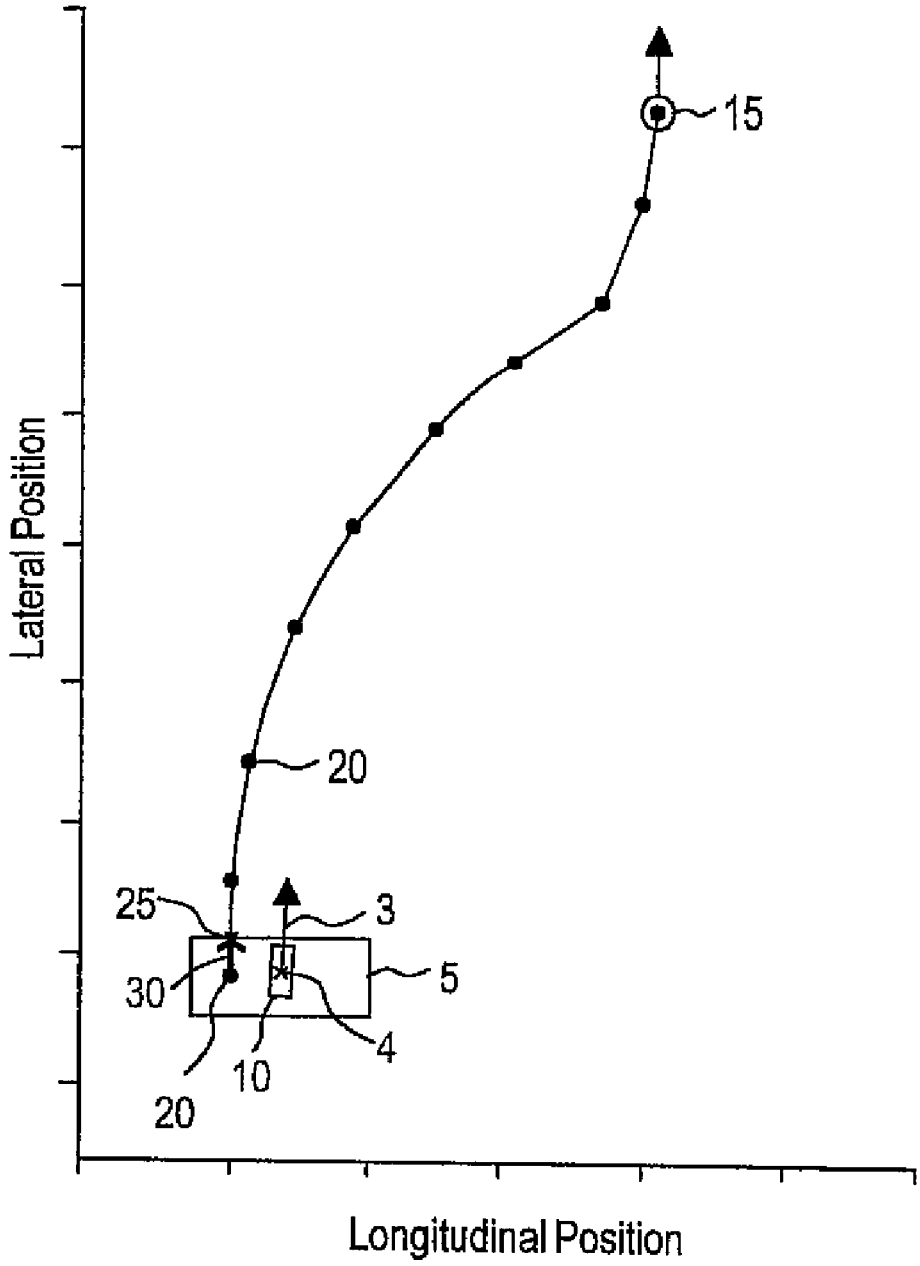
FIG. 3 is a depiction of a lateral position and longitudinal position of a transmitting and receiving vehicle indicating a bounding area of the receiving vehicle, the data information of the transmitting vehicle and a single intersection of the data points and the bounding area.

However, if various intersection points 25 exist farther steps are performed. If exactly one intersection point 25 exists, as shown in FIG. 3 the receiving vehicle 10 will compute a vector 30 from the intersection point 25 to the current position of the transmitting vehicle 15. Next, the receiving vehicle 10 will determine if the vector 30 is within an angular bound of the orientation of the receiving vehicle's current orientation to determine if the data information is relevant.

If two or more intersection points 25 exist between the data information and the bounding area 5, the various temporal or time values of the intersection points are computed, as outlined above, and a value of the intersection point is stored. Next a vector 30 of the intersection point 25 is computed by sorting the timestamps of the various intersection points 25 and utilizing the two most recent points to compute a vector 30 from the second newest point to the newest point. Following the computation of the vector 30 of the intersection points 25, it is determined if the vector 30 is within an angular bound of the orientation of the receiving vehicle's current orientation to determine if the signal sent by the transmitting vehicle is relevant.

In the step of determining if the orientation of the vector is within an angular bound of the orientation of the receiving vehicle's current orientation, various angular bound values can be utilized. In one aspect, the angular bound may vary from plus or minus 5 degrees to plus or minus 35 degrees.

As can be seen from the above description, the method for avoiding a collision in a vehicle of the invention eliminates the need for a GPS map of various vehicles in relation to each other. The method allows for the determination of the relevancy of the data information from a transmitting vehicle to a receiving vehicle utilizing only the current position and heading of the receiving vehicle as well as the data information from the transmitter.

The invention has been described in an illustrative manner. It is to be understood that the terminology which has been used is intended to be in the nature of words of description rather than limitation. Many modifications and variations of the invention are possible in light of the above teachings. Therefore, within the scope of the appended claims, the invention may be practiced other than as specifically described.

The invention claimed is:

1. A method for avoiding a collision in a vehicle comprising the steps of:

providing a transmitting vehicle;

providing a receiving vehicle;

creating data information including a plurality of data points having a position element and a temporal element in the transmitting vehicle;

sending the data information to the receiving vehicle;

creating a bounding area in the receiving vehicle;

calculating a line segment formula for each consecutive pair of data points of the data information and determining if the line segment intersects with a perimeter of the bounding area; and computing a vector of the intersection point, if any, and determining if the vector is within an angular bound of the orientation of the receiver's current orientation to determine if the data information is relevant.

2. The method of claim 1 wherein the data information is sent to the receiving vehicle periodically.

3. The method of claim 1 wherein the data information is sent to the receiving vehicle in response to an event of the transmitting vehicle.

4. The method of claim 1 wherein the plurality of data points have equally spaced temporal elements.

5. The method of claim 1 wherein the number of data points is determined by run time calculations.

6. The method of claim 1 wherein the data information is represented by curves.

7. The method of claim 1 wherein the data information is represented by cubic spline interpolations.

8. The method of claim 1 wherein the bounding area is selected from polygons and circular shapes.

9. The method of claim 1 wherein the bounding area is created in relation to vehicle and road parameters.

10. The method of claim 1 wherein the bounding area is variable for incorporating dynamic vehicle and driving parameters.

11. The method of claim 1 wherein the bounding area is centered about the receiving vehicle.

12. The method of claim 1 wherein the data information includes the current position and current temporal information of the transmitting vehicle.

13. The method of claim 1 including the steps of:

computing a temporal value of the intersection point; and storing a value of the intersection point.

14. A method for avoiding a collision in a vehicle comprising the steps of:

providing a transmitting vehicle;

providing a receiving vehicle;

creating data information having a plurality of data points in the transmitting vehicle;

sending the data information to the receiving vehicle;

creating a bounding area in the receiving vehicle;

calculating a line segment formula for each consecutive pair of data points of the data information; and determining if the line segment intersects with a perimeter of the bounding area;

computing a vector of the intersection point, if any, and determining if the vector is within an angular bound of the orientation of the receiver's current orientation and then determining if the data information is relevant.

15. The method of claim 14 wherein when there is no intersection point the sent data information is determined to be irrelevant.

16. The method of claim 14 including the steps of:

computing a temporal value of the intersection point if determined; and storing a value of the intersection point.

17. The method of claim 14 wherein a single intersection point is determined and the vector is formed from the intersection point to the current position of the transmitting vehicle.

18. The method of claim 14 wherein multiple intersection points are determined and the multiple intersection points are sorted by the temporal values and the two most recent temporal intersection points are used to form the vector from the second newest temporal value to the newest temporal value.

19. The method of claim 14 wherein the angular bound is from plus or minus 5 degrees to plus or minus 35 degrees.

* * * * *

UNITED STATES PATENT AND TRADEMARK OFFICE

CERTIFICATE OF CORRECTION

PATENT NO. : 7,813,877 B2
APPLICATION NO. : 11/554084
DATED : October 12, 2010
INVENTOR(S) : Lorenzo Caminiti et al.

It is certified that error appears in the above-identified patent and that said Letters Patent is hereby corrected as shown below:

Column 3, line 4 replace “fine” with --line--

Column 3, line 13 replace “farther” with --further--

Signed and Sealed this
Fourteenth Day of June, 2011

David J. Kappos

David J. Kappos
*Director of the United States Patent and Trademark Office*